United States Patent [19]

Sweatman et al.

[11] Patent Number: 5,040,898

[45] Date of Patent: Aug. 20, 1991

[54] MIXING APPARATUS AND METHOD

[75] Inventors: Denis R. Sweatman, Corinda; John D. Petty, Holland Park; Russell M. Peachey, Durack, all of Australia

[73] Assignee: Ionode Pty. Ltd., Queensland, Australia

[21] Appl. No.: 423,392

[22] PCT Filed: Mar. 1, 1988

[86] PCT No.: PCT/AU88/00054

§ 371 Date: Nov. 3, 1989

§ 102(e) Date: Nov. 3, 1989

[87] PCT Pub. No.: WO88/06485

PCT Pub. Date: Sep. 7, 1988

[30] Foreign Application Priority Data

Mar. 2, 1987 [AU] Australia ..... PI0595

[51] Int. Cl.[5] ..... B01F 13/08

[52] U.S. Cl. ..... 366/273; 366/127; 366/178

[58] Field of Search ..... 366/273, 274, 150, 178, 366/127, 116

[56] References Cited

U.S. PATENT DOCUMENTS

| | | | |
|---|---|---|---|
| 2,212,288 | 8/1940 | Decker . | |
| 3,268,212 | 8/1966 | Ziselberger | 366/178 |
| 3,433,465 | 3/1969 | Szpur . | |
| 3,689,033 | 9/1972 | Holmstrom | 366/273 |
| 3,763,873 | 10/1973 | Saunders | 366/273 |
| 3,995,835 | 12/1976 | Cichy | 366/273 |
| 4,526,046 | 7/1985 | Oberli . | |

FOREIGN PATENT DOCUMENTS

| | | | |
|---|---|---|---|
| 1078347 | 10/1957 | Fed. Rep. of Germany . | |
| 1065519 | 9/1959 | Fed. Rep. of Germany . | |
| 3344794 | 8/1984 | Fed. Rep. of Germany . | |
| 1334032 | 10/1973 | United Kingdom | 366/273 |

*Primary Examiner*—Robert W. Jenkins

*Attorney, Agent, or Firm*—Knobbe, Martens, Olson & Bear

[57] ABSTRACT

Fluid mixing apparatus includes a non-magnetic conduit (4) and a magnetically susceptible rod (5) which is contained in and extends longitudinally of the conduit. The rod is substantially not permanently magnetized. A least two electromagnets (6, 7) are positioned externally of the conduit so that each may, when activated, individually cause movement of the rod across the conduit. The electromagnets may be activated in turn and one at a time to induce an effective vibratory mixing motion of the rod within the conduit.

20 Claims, 1 Drawing Sheet

MIXING APPARATUS AND METHOD

FIELD OF THE INVENTION

This invention relates to the mixing of two or more fluids especially for purposes related to chemical analysis.

BACKGROUND ART

Several magnetic mixing devices for fluid streams have been described. U.S. Pat. Nos. 3,219,318 to Herschler, 3,680,843 to Lu et al, 3,689,033 to Holmstrom et al, 3,907,258 to Spaziani, and 4,054,270 to Gugger et al disclose the location of permanent magnets in a fluid stream within a conduit for agitation by an external magnetic field which reverses in polarity. This magnetic field is typically provided by a single electromagnet having its poles to opposite sides of the condut. Another device, described in U.S. Pat. No. 3,763,873 to Saunders, uses a magnetically susceptible tubular reed which also serves as an inlet tube and is therefore fixed at one end. The free end is agitated and indeed vibrated by a spinning permanent magnet. Other prior magnetic mixing configurations are disclosed in U.S. Pat. Nos. 2,999,673 to Kessler, 3,784,170 to Peterson et al, 3,793,886 to Rosenwald and 3,995,835 to Cichy et al.

Many flow based methods for chemical analysis, for example high pressure liquid chromatography and discontinuous flow analysis (described in the present applicant's international patent application No. PCT/AU86/00323), require two or more fluid streams to be mixed uniformly transverse to the direction of flow but so that any time variation in the ratio of comonents of the streams is maintained without appreciable broadening in the direction of the flow. In this respect, the arrangements of the prior art are severely limited, particularly where small bore tubing, for example less than 1 mm internal diameter, is involved. Minature magnets suitable for insertion in such tubing are not commonly available and must be matched in size to the external magnetic field to provide effective coupling. Further, the turbulence arising from the Y and T fluid junctions of the aforementioned U.S. Pat. Nos. 3,689,033 and 3,907,258 respectively will cause disruption of the ratio of components prior to mixing. The violent agitation at the point of confluence in U.S. Pat. No. 3,763,873 will cause considerable broadening, as will the movement of the "plurality of permanent magnets" of U.S. Pat. No. 3,219,318. U.S Pat. No. 3,763,873 does not use a permanent magnet for agitation, but the mixing action is restricted to a very small part of the flow line in the vicinity of the end of the tubular reed and is not considered effective for high flow rates.

SUMMARY OF THE INVENTION

A principal object of the present invention is therefore to provide for simple effective mixing of two or more fluids with minimal longitudinal broadening of the components. The process is preferably operable at high or low flow rates and at any pressure, and the apparatus is desirably constructed from commonly available material.

The present invention entails the realization that substantial benefits in line with these objects can be achieved by utilising a novel magnetic mixing arrangement in which a rod of magnetically susceptible material for example a ferro-magnetic material and preferably a common arculable material such as iron wire, is vibrated by two magnetic fields which are switched alternately, thus relaxing the matching size conditions of permanent-magnet vibrating elements and providing maximum magnetic attractive force with maximum efficiency. This arrangement, inter alia, allows extension of the agitating rod beyond the vicinity of the magnets to incorporate debubbling and scouring of the sensing zone of a conduit.

According to one aspect of the present invention there is therefore provided fluid mixing apparatus comprising:

- a non-magnetic conduit;
- a magnetically susceptible rod contained in and extending longitudinally of said conduit, which rod is substantially not permanently magnetized;
- at least two electromagnets positioned externally of said conduit so that each may, when activated, individually cause movement of said rod across the conduit; and
- whereby said electromagnets may be activated in turn and one at a time to induce an effective vibratory mixing motion of said rod within the conduit.

According to another aspect of the invention, there is provided a method of mixing two or more fluids, comprising:

- directing the fluids along a non-magnetic conduit containing a magnetically susceptible rod which extends longitudinally of the conduit; and
- activating in turn and one at a time two or more electromagnets positioned externally of said conduit so that each, when activated, individually causes movement of said rod across the conduit, whereby to induce an effective vibratory mixing motion of said rod within the conduit.

Preferably, each electromagnet comprises a pair of opposite poles spaced apart along the conduit, and wherein said rod passes both poles of each electromagnet.

The apparatus may further include a sensor operatively associated with a sensing zone of the conduit to monitor the mixed fluids therein, wherein said rod extends beyond the vicinity of said electromagnets into the sensing zone for utilising said vibratory motion of the rod ot effect debubbling and/or scouring or cleaning of the conduit in the sensing zone.

BRIEF DESCRIPTION OF THE DRAWING

In order that the invention may be clearly understood and readily carried into effect, a preferred embodiment and exemplary methods of operation will now be described, with reference to the accompanying drawing, which is a sectional rather schematic view of mixing apparatus according to the invention.

BEST MODES FOR CARRYING OUT THE INVENTION

Figure 1:
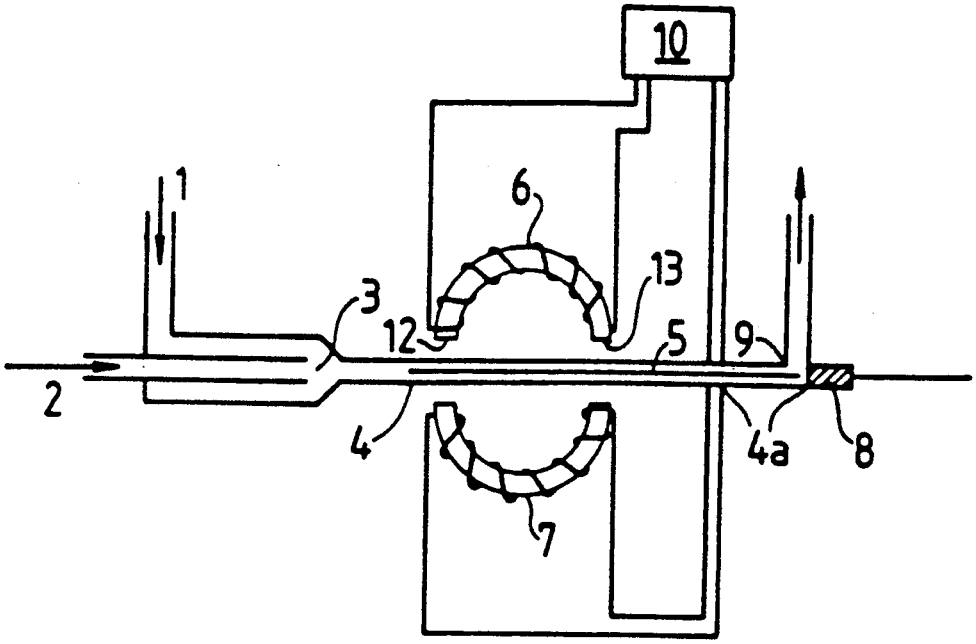

Referring to the figure, streams of fluid 1 and 2 respectively unite at coaxial fluid junction 3 and then travel through a conduit 4 which contains a magnetically susceptible rod 5, preferably of ferromagnetic material. Rod 5 is not permanently magnetized, extends longitudinally of conduit 4, and is laterally vibrated, i.e. across the conduit, by two opposing electromagnets 6 and 7 positioned externally of the conduit so that each may, when activated, individually cause movement of rod 5 across conduit 40. Further downstream of the region between the electromagnets is a sensing zone 4*a* in which the fluid in the conduit is monitored by an sensor 8. Rod 5 extends into the sensing zone and may also touch sensor 8 to provide a cleaning action. Sensor 8 may be a membrane, thermistor, transparent section for optical sensing, or the like. Tubular sensors are also useable, in which case the rod may extend through the sensor. Conduit 4 makes an angle turn 9 in the vicinity of sensor 8, to prevent displacement of the rod.

Rod 5 consists of a fine iron wire, encapsulated or plated for chemical resistance, and typically 0.1–0.8 mm in diameter and 10 to 100 mm in length in a tube of 0.5 to 2.0 mm internal diameter. The ratio between the rod cross-section and the internal tube cross-section may vary considerably but should not be so large as to present an unacceptable restriction in the conduit or so small as to be ineffective in mixing the fluids.

Each electromagnet is a simple coil about a horseshoe-shaped iron core, thus providing a pair of opposite (north and south) poles (12, 13 for electromagnet 6) spaced apart along conduit 4. Rod 5 passes both poles of each electromagnet, and indeed the poles of the respective electromagnets are directly opposite each other.

A power supply unit 10 of electromagnets 6, 7 is arranged to deliver appropriate current to and thereby activate electromagnets one at a time. Moreover, unit 10 includes control circuitry for activating the electromagnets in turn, in this case alternately at a frequency in the range 10 to 100 Hz, to induce an effective vibratory mixing motion of rod 5 within the conduit.

It will be appreciated that the unmagnetised but magnetically susceptible material of rod 5, is attracted to both poles, north and south, 12, 13, of each activated electromagnet and cannot distinguish between the two poles. In the present invention one electromagnet is switched on while the other is off so that both the north and south poles of the former strongly attract the mixing rod to one side of the conduit. The operation is reversed so that the rod is strongly attracted to the other side of the conduit. This process is repeated at high speeds, for example in the aforementioned preferred range 10 to 100 Hz, and has been found in practice to be effectively operable on very fine iron with rods. It should be noted that the rod 5 may be very long relative to its diameter, thus providing very effective lateral mixing, but without significant broadening because of its small diameter. Furthermore, the coaxial junction has been found in practice to significantly improve the quality of flow profiles and peaks. Essentially, the fluid streams should unite with as little mixing as possible and preferably the mixing should take place somewhat downstream from the junction 3 so as not to disrupt the union of streams at the junction.

It will be noted that the attraction of rod 5 by two spaced poles 12, 13, ensures a very positive transverse movement of the rod, with little end-to-end rocking or rotation. Because of this positive control of the rod, it can be projected beyond the region of the electromagnets into the sensing zone 4*a* and the vibratory motion of the rod can be utilised to effect debubbling and/or scouring or cleaning the conduit 4 in the sensing zone 4*a*.

Although only one embodiment of the invention has been described in detail above it should be understood that various changes can be carried out without departing from the spirit or scope of the invention. Thus more than two electromagnets may be employed, spaced about the conduit to produce more complex oscillation patterns, more than one rod may be disposed in the conduit, or more than two streams may unite either coaxially, serially, or by concentric means. The rod may also be circular in section or any other profile.

Although at least two electromagnets are desirable, only one pole of each electromagnet is necessary to cause agitation, e.g. where space considerations do not permit the illustrated horseshoe type electromagnet to be used. In this case, two rod-shaped electromagnets would be opposed and transverse to the conduit.

We claim:

1. Fluid stream mixing apparatus comprising:

a non-magnetic conduit for a fluid stream;

a magnetically susceptible rod contained in and extending longitudinally of said conduit, which rod is substantially not permanently magnetized;

at least two electromagnets positioned externally of said conduit so that each may, when activated, individually cause movement of said rod across the conduit;

whereby said electromagnets may be activated in turn and one at a time to induce an effective vibratory mixing motion of said rod within the conduit by causing movement of said rod in alternate directions across said conduit.

2. Fluid mixing apparatus according to claim 1, wherein each electromagnet comprises a pair of opposite poles spaced apart along the conduit, and wherein said rod passes both poles of each electromagnet.

3. Fluid mixing apparatus according to claim 2 wherein said electromagnets are substantially on opposite sides of the conduit.

4. Fluid mixing apparatus according to claim 2 further comprising a junction in the conduit at which the fluids are coaxially brought together upstream of said rod.

5. Fluid mixing apparatus according to claim 2 further including a sensor operatively associated with a sensing zone of the conduit to monitor the mixing fluids therein, wherein said rod extends beyond the vicinity of said electromagnets into the sensing zone for utilizing said vibratory motion of the rod to effect the bubbling and/or scouring or cleaning of the conduit in the sensing zone.

6. Fluid mixing apparatus according to claim 2 further comprising means to activate said electromagnets in turn and one at a time.

7. Fluid mixing apparatus according to claim 1 wherein said electromagnets are substantially on opposite sides of the conduit.

8. Fluid mixing apparatus according to claim 7 further comprising a junction in the conduit at which the fluids are coaxially brought together upstream of said rod.

9. Fluid mixing apparatus according to claim 7 further including a sensor operatively associated with a sensing zone of the conduit to monitor the mixing fluids therein, wherein said rod extends beyond the vicinity of said electromagnets into the sensing zone for utilzing said vibratory motion of the rod to effect the bubbling and/or scouring or cleaning of the conduit in the sensing zone.

10. Fluid mixing apparatus according to claim 7 further comprising means to activate said electromagnets in turn and one at a time.

11. Fluid mixing apparatus according to claim 1, further comprising a junction in the conduit at which the fluids are co-axially brought together upstream of said rod.

12. Fluid mixing apparatus according to claim 11 further including a sensor operatively associated with a sensing zone of the conduit to monitor the mixing fluids therein, wherein said rod extends beyond the vicinity of said electromagnets into the sensing.

13. Fluid mixing apparatus according to claim 11 further comprising means to activate said electromagnets in turn and one at a time.

14. Fluid mixing apparatus according to any claim 1 further including a sensor operatively associated with a sensing zone of the conduit to monitor the mixed fluids therein, wherein said rod extends beyond the vicinity of said electromagnets into the sensing zone of utilising said vibratory motion of the rod to effect debubbling and/or scouring or cleaning of the conduit in the sensing zone.

15. Fluid mixing apparatus according to claim 1 wherein said rod comprises iron wire protected against corrosion within said fluids.

16. Fluid mixing apparatus according to claim further comprising means to activate said electromagnets in turn and one at a time.

17. A method of mixing two or more fluids comprising:

directing the fluids along a non-magnetic conduit containing a magnetically susceptible rod which extends longitudinally of the conduit; and activating in turn and one at a time two or more electromagnets positioned externally of said conduit so that each, when activated, individually causes movement of said rod across the conduit, whereby to induce an effective vibratory mixing motion of said rod within the conduit.

18. A method according to claim 17, further comprising bringing said fluids together at a co-axial junction upstream of said rod.

19. A method according to claim 18 further comprising utilizing said vibratory motion of the rod to effect debubbling and/or scouring or cleaning the conduit in a sensing zone of the conduit defined by being operatively associated with a sensor.

20. A method according to claim 17, further comprising utilising said vibratory motion of the rod to effect debubbling and/or scouring or cleaning the conduit in a sensing zone of the conduit defined by being operatively associated with a sensor.

* * * * *

UNITED STATES PATENT AND TRADEMARK OFFICE
CERTIFICATE OF CORRECTION

PATENT NO. : 5,040,898

DATED : August 20, 1991

INVENTOR(S) : Sweatman, et al.

It is certified that error appears in the above-identified patent and that said Letters Patent is hereby corrected as shown below:

Column 5, line 7, after "sensing", add --zone for utilizing said vibratory motion of the rod to effect the bubbling and/or scouring or cleaning of the conduit in the sensing zone--.

Column 5, line 14, change "mixed" to --mixing--.

Column 5, line 16, change "of" to --for--.

Column 5, line 17, change "debubbling" to --bubbling--.

Column 5, line 23, Change "claim further"to read --claim 1 further--.

Signed and Sealed this

Sixth Day of April, 1993

*Attest:*

STEPHEN G. KUNIN

*Attesting Officer*

*Acting Commissioner of Patents and Trademarks*